US011744330B2

(12) United States Patent
Lu et al.

(10) Patent No.: US 11,744,330 B2
(45) Date of Patent: Sep. 5, 2023

(54) COMPOSITE CLEAT

(71) Applicant: COMPLAM MATERIAL CO., LTD., Taichung (TW)

(72) Inventors: Chia Yang Lu, Taichung (TW); Sheng Yen Wu, Taichung (TW); Yi Wen Xiao, Taichung (TW)

(73) Assignee: COMPLAM MATERIAL CO., LTD., Taichung (TW)

( * ) Notice: Subject to any disclaimer, the term of this patent is extended or adjusted under 35 U.S.C. 154(b) by 0 days.

(21) Appl. No.: 17/565,609

(22) Filed: Dec. 30, 2021

(65) Prior Publication Data

US 2022/0218072 A1 Jul. 14, 2022

(30) Foreign Application Priority Data

Jan. 12, 2021 (TW) ..... 110200364

(51) Int. Cl.
*A43C 15/16* (2006.01)

(52) U.S. Cl.
CPC ..... *A43C 15/16* (2013.01)

(58) Field of Classification Search
CPC ..... A43C 15/16; A43C 15/161; A43C 15/167; A43C 15/168
USPC ..... 36/67 d, 134
See application file for complete search history.

(56) References Cited

U.S. PATENT DOCUMENTS 2,177,155 A * 10/1939 Shapiro ..... A43C 15/161 36/134
2,330,458 A * 9/1943 Tubbs ..... A43C 15/161 36/134
3,054,197 A * 9/1962 Morgan ..... A43C 15/161 36/67 D
3,331,148 A * 7/1967 Hollister ..... A43C 15/161 36/67 A
4,712,318 A * 12/1987 Greiner ..... A43C 15/161 36/134
5,361,518 A * 11/1994 Sussmann ..... A43C 15/167 36/134
6,381,878 B1 * 5/2002 Kennedy, III ..... A43C 15/168 36/134
2012/0180343 A1 * 7/2012 Auger ..... A43B 13/26 12/146 B

* cited by examiner

*Primary Examiner* — Ted Kavanaugh
(74) *Attorney, Agent, or Firm* — Alan D. Kamrath; Karin L. Williams; Mayer & Williams PC

(57) ABSTRACT

A composite cleat includes a first component and a second component. The first component is made of a first material and is formed a first connecting portion extended along a longitudinal axis and a ground contact surface disposed at one end thereof. The second component is made of a second material different from the first material and is formed a second connecting portion fixedly connected with the first connecting portion and a threaded stud disposed at one end thereof.

7 Claims, 3 Drawing Sheets

COMPOSITE CLEAT

BACKGROUND

The present invention relates to a cleat for an athletic shoe and particularly to a composite cleat constructed from a metal material and a nonmetal material.

Cleats for athletic shoes have long been used to provide traction in dirt and grass. Such cleat typically has been made of a single material such as metal, ceramic or plastic. The metal cleats cannot reduce the weight of numbers of cleats. The ceramic cleats have high hardness but easy breakage. The plastic cleats are low in cost and light in weight but easily subjected to abrasion.

Thus, in spite of the variety of alternative cleats now available, improvements in cleats for athletic shoes are still being sought.

SUMMARY

An objective of the present invention is to provide a composite cleat, which includes a first component and a second component. The first component is made of a first material and is formed a first connecting portion extended along a longitudinal axis and a ground contact surface disposed at one end thereof. The second component is made of a second material different from the first material and is formed a second connecting portion fixedly connected with the first connecting portion and a threaded stud disposed at one end thereof.

In an embodiment, the first material is a carbon fiber composite material, and the second material is a metal material.

In an embodiment, the second material is an aluminum metal material.

In an embodiment, the first connecting portion is formed in the shape of a recess and has at least one middle internal diameter section, a large internal diameter section, and a small internal diameter section disposed between the at least one middle internal diameter section and the large internal diameter section. The second connecting portion is formed in the shape of a column and has at least one middle external diameter section, a large external diameter section, and a small external diameter section disposed between the at least one middle external diameter section and the large external diameter section. The at least one middle external diameter section corresponds and is fixedly connected to the at least one middle internal diameter section. The large external diameter section corresponds and is fixedly connected to the large internal diameter section. The small external diameter section corresponds and is fixedly connected to the small internal diameter section.

In an embodiment, the threaded stud is extendedly formed from the large external diameter section along the longitudinal axis.

In an embodiment, an outer periphery of the first component is formed a plurality of grooves arranged at equal intervals around the longitudinal axis.

In an embodiment, one end of the first component opposite to the ground contact surface is formed a disk portion disposed adjacent to the plurality of grooves.

In an embodiment, an end face of the disk portion forms an annular recess around the threaded stud.

The present invention will become clearer in light of the following detailed description of illustrative embodiments of this invention described in connection with the drawings.

DETAILED DESCRIPTION

Figure 1:
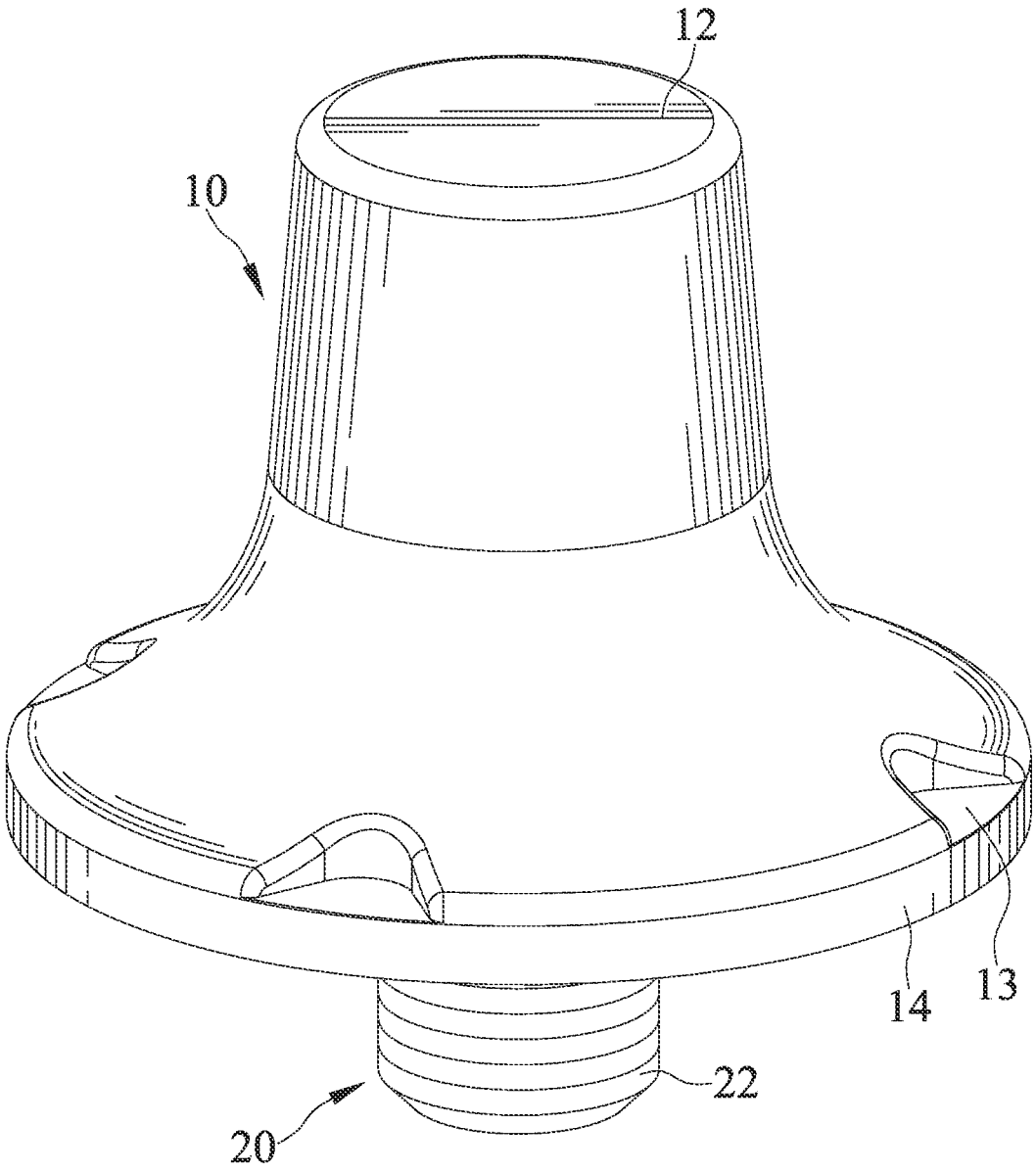
FIG. 1 is a perspective view of a composite cleat of an embodiment according to the present invention.
Figure 2:
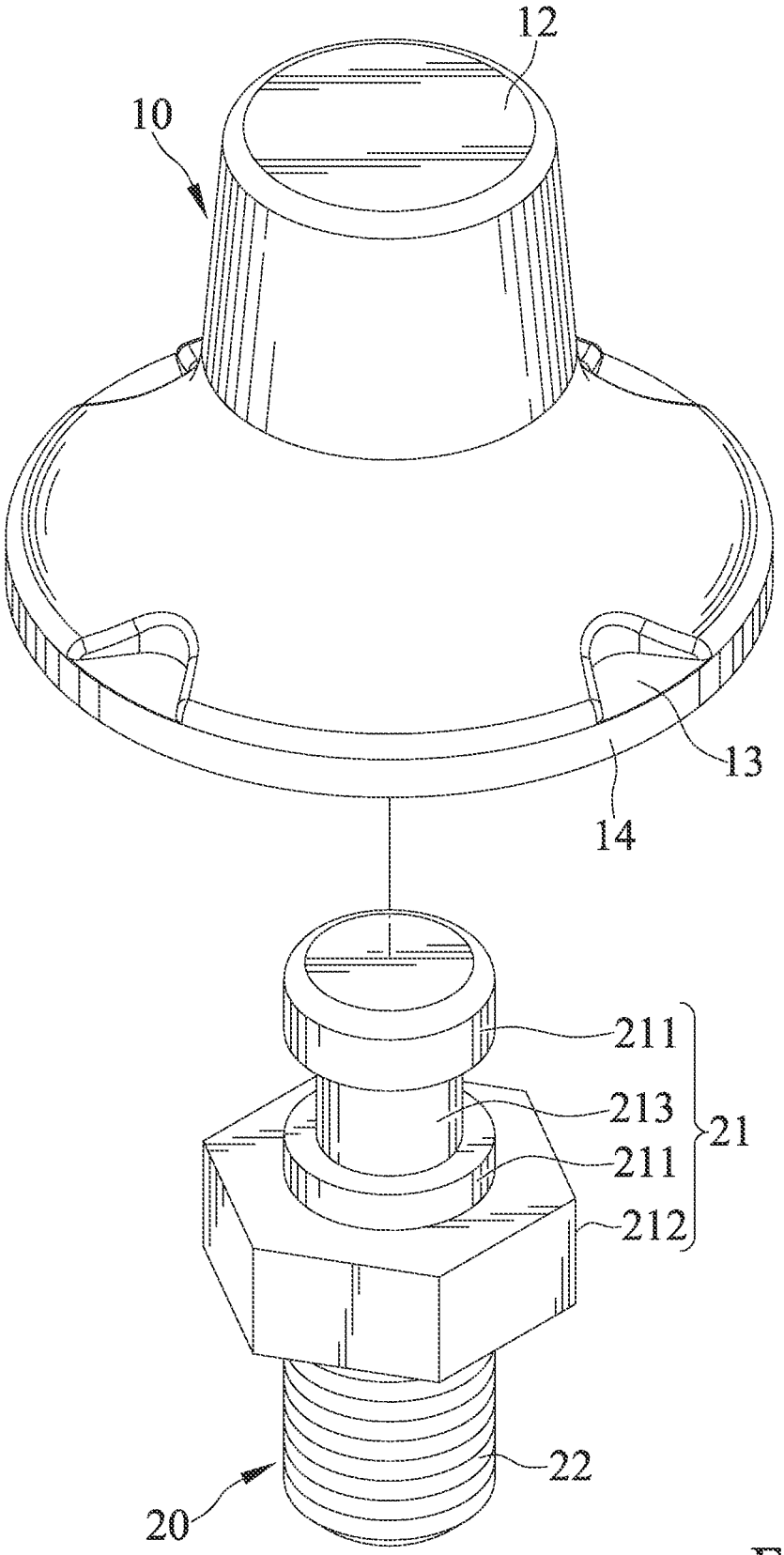
FIG. 2 is an exploded, perspective view of the composite cleat of FIG. 1.
Figure 3:
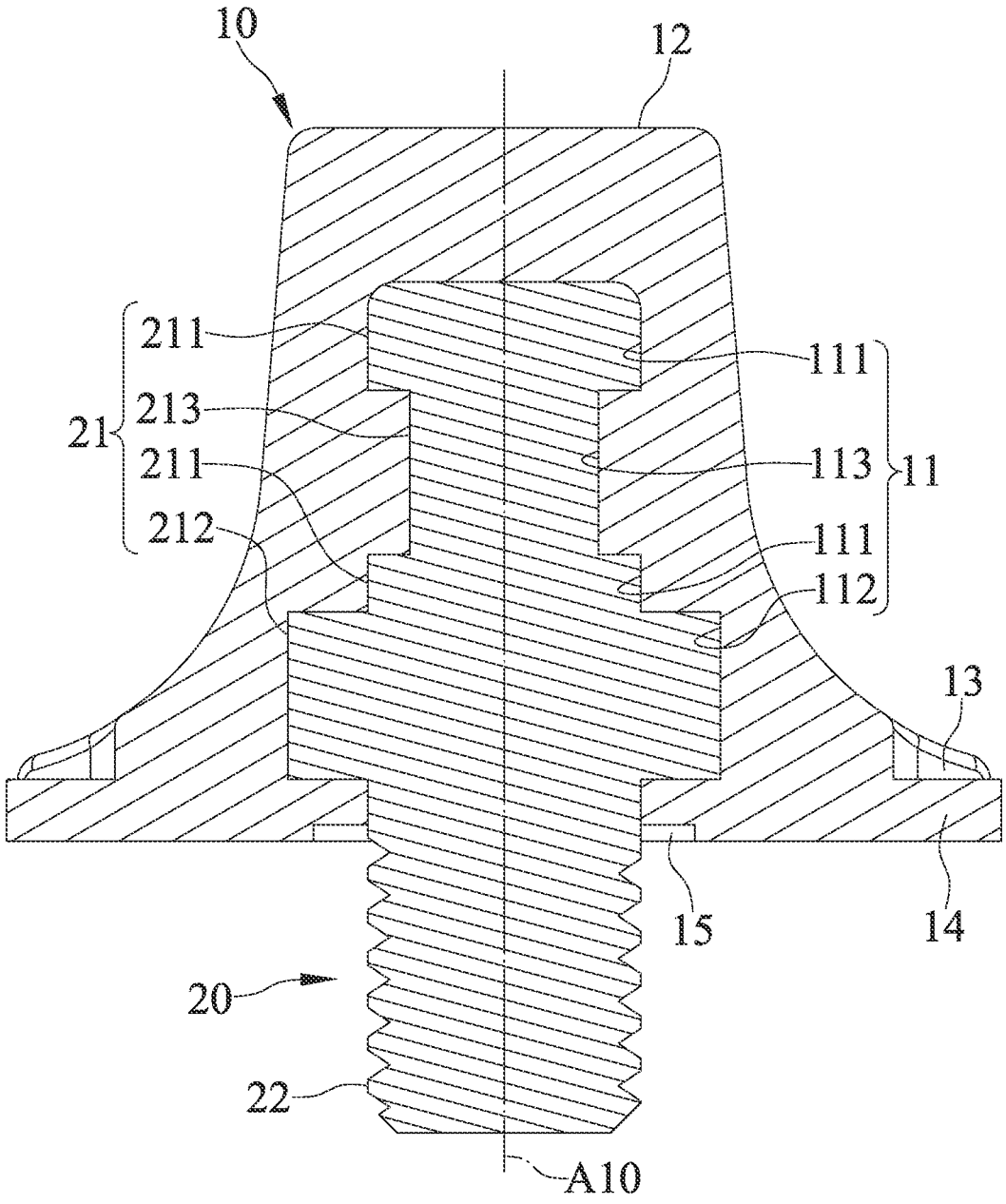
FIG. 3 is a cross sectional view of the composite cleat of FIG. 1.

FIGS. 1-3 show a composite cleat for an athletic shoe of an embodiment according to the present invention. The composite cleat includes a first component 10 and a second component 20 fixedly connected with the first component 10. The first component 10 is made of a first material. The second component 20 is made of a second material different from the first material. In the embodiment, the first material may be a carbon fiber composite material, and the second material may be a metal material, such as an aluminum metal material.

The first component 10 is formed a first connecting portion 11 extended along a longitudinal axis A10 and a ground contact surface 12 disposed at one end thereof. Further, the first connecting portion 11 is formed in the shape of a recess and has at least one middle internal diameter section 111, a large internal diameter section 112, and a small internal diameter section 113 disposed between the at least one middle internal diameter section 111 and the large internal diameter section 112.

An outer periphery of the first component 10 is formed a plurality of grooves 13 arranged at equal intervals around the longitudinal axis A10, and one end of the first component 10 opposite to the ground contact surface 12 is formed a disk portion 14 disposed adjacent to the plurality of grooves 13.

The second component 20 is formed a second connecting portion 21 fixedly connected with the first connecting portion 11 and a threaded stud 22 disposed at one end thereof and adapted for mounting to a threaded hole at a sole (not shown). Further, the second connecting portion 21 is formed in the shape of a column and has at least one middle external diameter section 211, a large external diameter section 212, and a small external diameter section 213 disposed between the at least one middle external diameter section 211 and the large external diameter section 212.

The at least one middle external diameter section 211 corresponds and is fixedly connected to the at least one middle internal diameter section 111. The large external diameter section 212 corresponds and is fixedly connected to the large internal diameter section 112. The small external diameter section 213 corresponds and is fixedly connected to the small internal diameter section 113. Thus, the first component 10 and the second component 20 are firmly joined to form the composite cleat.

In the embodiment, the first connecting portion 11 may have two middle internal diameter sections 111 respectively connected with two opposite ends of the small internal diameter section 113 along the longitudinal axis A10. One of the two middle internal diameter sections 111 is disposed to a terminal end of the first connecting portion 11, and the other middle internal diameter section 111 is connected to the large internal diameter section 112. Accordingly, the second connecting portion 21 may have two middle external diameter sections 211 respectively connected with two opposite ends of the small external diameter section 213 along the longitudinal axis A10. One of the two middle external diameter sections 211 is disposed to a terminal end of the second connecting portion 21, and the other middle external diameter section 211 is connected to the large external diameter section 212.

In the embodiment, the threaded stud 22 may be extendedly formed from the large external diameter section 212 along the longitudinal axis A10 and exposed out of the disk portion 14, and an end face of the disk portion 14 may form an annular recess 15 around the threaded stud 22.

In addition, the first component 10 and the second component 20 can be processed by a special process, so that the two dissimilar materials can be connected more easily and have a better combination. Generally, the original carbon fiber composite material can be processed and molded into a base material to form the first component 10, and the aluminum material can be processed and surface treated to form the second component 20, and the first component 10 can join with the second component 20 by hot pressing.

In summary, the composite cleat made of at least two different materials (the first and second materials) can have high pulling force resistance, high rigidity and lightweight (compared with an aluminum cleat, it can reduce weight by 40-50%) and other functions, to perfectly replace a conventional cleat made of a single material.

Although specific embodiments have been illustrated and described, numerous modifications and variations are still possible without departing from the scope of the invention. The scope of the invention is limited by the accompanying claims.

The invention claimed is:

1. A composite cleat comprising:

a first component made of a first material, wherein the first component is formed a first connecting portion extended along a longitudinal axis and a ground contact surface disposed at one end thereof, wherein the first connecting portion is formed in the shape of a recess and has at least one middle internal diameter section, a large internal diameter section, and a small internal diameter section disposed between the at least one middle internal diameter section and the large internal diameter section;

a second component made of a second material different from the first material, wherein the second component is formed a second connecting portion fixedly connected with the first connecting portion and a threaded stud disposed at one end thereof, wherein the second connecting portion is formed in the shape of a column and has at least one middle external diameter section, a large external diameter section, and a small external diameter section disposed between the at least one middle external diameter section and the large external diameter section, wherein the at least one middle external diameter section corresponds and is fixedly connected to the at least one middle internal diameter section, wherein the large external diameter section corresponds and is fixedly connected to the large internal diameter section, and wherein the small external diameter section corresponds and is fixedly connected to the small internal diameter section, wherein each of the at least one middle external diameter section and the small external diameter section has a circular section shape, and wherein the large external diameter section has a hexagonal section shape.

2. The composite cleat as claimed in claim 1, wherein the first material is a carbon fiber composite material, and wherein the second material is a metal material.

3. The composite cleat as claimed in claim 2, wherein the second material is an aluminum metal material.

4. The composite cleat as claimed in claim 1, wherein the threaded stud is extendedly formed from the large external diameter section along the longitudinal axis.

5. The composite cleat as claimed in claim 1, wherein an outer periphery of the first component is formed a plurality of grooves arranged at equal intervals around the longitudinal axis.

6. The composite cleat as claimed in claim 5, wherein one end of the first component opposite to the ground contact surface is formed a disk portion disposed adjacent to the plurality of grooves.

7. The composite cleat as claimed in claim 6, wherein an end face of the disk portion forms an annular recess around the threaded stud.

* * * * *